US008089309B2

(12) United States Patent
Jansen et al.

(10) Patent No.: US 8,089,309 B2
(45) Date of Patent: Jan. 3, 2012

(54) TRANSIMPEDANCE AMPLIFIER INPUT STAGE MIXER

(75) Inventors: Douglas S. Jansen, Pelham, NH (US); Gregory M. Flewelling, Bedford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 12/492,682

(22) Filed: Jun. 26, 2009

(65) Prior Publication Data

US 2010/0327941 A1 Dec. 30, 2010

(51) Int. Cl.
*G06G 7/12* (2006.01)

(52) U.S. Cl. ..... 327/359; 327/357; 455/326

(58) Field of Classification Search ..... 327/355–361; 455/323, 326

See application file for complete search history.

(56) References Cited

U.S. PATENT DOCUMENTS 4,931,746 A * 6/1990 Trankle et al. ..... 330/254
6,594,504 B1 * 7/2003 Grasset ..... 455/550.1
7,054,609 B2 * 5/2006 Wiklund et al. ..... 455/323
7,062,247 B2 * 6/2006 Kovacevic et al. ..... 455/323
7,088,980 B2 * 8/2006 Otaka ..... 455/323
7,382,191 B2 6/2008 Randlett
7,417,486 B2 * 8/2008 Koutani et al. ..... 327/359
7,446,590 B2 * 11/2008 Chung ..... 327/355
7,626,777 B2 * 12/2009 Aemireddy et al. ..... 360/25

OTHER PUBLICATIONS

Silver, "Gilbert Cell Mixer Design Tutorial".

Samadi B. et al., "Design of Transimpedance and Limiting Amplifiers for 10 Gb/s Optical Communication Systems", 2002 IEEE.

* cited by examiner

*Primary Examiner* — Dinh T. Le
(74) *Attorney, Agent, or Firm* — Finch & Maloney PLLC; Neil F. Maloney

(57) ABSTRACT

A Gilbert cell mixer design is disclosed. Instead of using a differential transconductance stage as typically done, the design employs a differential transimpedance amplifier input stage. By utilizing a transimpedance input stage to the Gilbert mixer, feedback is used to obtain higher linearity without sacrificing noise performance. The transimpedance input stage supplies a current signal to the cascode connected Gilbert switching quad, so the transimpedance amplifier output is taken from the collector of the transimpedance amplifier output transistor, instead of the emitter as normally done with transimpedance amplifiers.

20 Claims, 4 Drawing Sheets

TRANSIMPEDANCE AMPLIFIER INPUT STAGE MIXER

STATEMENT OF GOVERNMENT INTEREST

The invention was made with United States Government support under contract DAAB07-02-C-K513 awarded by the Army, and the United States Government may have certain rights in this invention.

FIELD OF THE INVENTION

The invention relates to mixer circuits, and more particularly, to Gilbert cell mixers.

BACKGROUND OF THE INVENTION

A so-called Gilbert cell or four-quadrant multiplier is a cross-coupled differential amplifier having a gain that can be linearly controlled by modulating emitter bias current. The amplitude of the differential input RF signal can be linearly controlled by a differential AC voltage. Gilbert cells are commonly used in a number of applications, including mixers, automatic gain control (AGC) amplifiers, amplitude and sideband modulators, amplitude modulation (μM) and sideband detectors, frequency doublers and dividers, squaring and square-root circuits.

The typical implementation of a Gilbert cell mixer utilizes a simple differential pair as the input transconductance stage. This is cascode connected with the Gilbert switching quad, which is typically driven by a local oscillator signal. Such mixer designs suffer from a number of problems, including poor linearity of the transconductance differential amplifier input stage. Conventional techniques such as emitter degeneration can be utilized to improve linearity, but this has a direct, negative impact on noise performance of Gilbert cell mixers.

There is a need, therefore, for improved Gilbert cell mixer designs.

SUMMARY OF THE INVENTION

One embodiment of the present invention provides a device for mixing signals. The device includes a Gilbert mixer stage having a cascode connected switching quad, and a differential transimpedance amplifier input stage operatively coupled to the Gilbert mixer stage. The differential transimpedance amplifier input stage is for generating a current signal that is applied to the cascode connected switching quad of the Gilbert mixer stage. In one example case, the differential transimpedance amplifier has an output transistor, and the current signal is taken from a collector of the output transistor. In another example case, the differential transimpedance amplifier has closed loop negative feedback taken from an emitter of an output transistor. In another example case, the differential transimpedance amplifier comprises an input transistor and an output transistor. An input signal is applied to a base of the input transistor, and an impedance at a collector of the input transistor produces open-loop voltage gain, and amplified signals on the collector of the input transistor are applied to a base of the output transistor. In one such case, the current signal is taken from a collector of the output transistor. In another such case, the input transistor is connected in a common emitter configuration. In another such case, emitter voltage of the input transistor is raised by a diode. In some cases, the differential transimpedance amplifier can be configured with degenerated current sources for facilitating rejection of common mode input signals. In another specific configuration, the device may be included, for example, in a system-on-chip (e.g., for integrated applications that require signal mixing), or may be implemented with discrete components. Any number of variations will be apparent in light of this disclosure.

For instance, another embodiment of the present invention provides a device for mixing signals that includes a Gilbert mixer stage having a cascode connected switching quad, and a differential transimpedance amplifier input stage operatively coupled to the Gilbert mixer stage, for generating a current signal that is applied to the cascode connected switching quad of the Gilbert mixer stage. In this example configuration, the differential transimpedance amplifier has an output transistor, and the current signal is taken from a collector of the output transistor, and the differential transimpedance amplifier has closed loop negative feedback taken from an emitter of the output transistor. The differential transimpedance amplifier may further comprise an input transistor, wherein an input signal is applied to a base of the input transistor and an impedance at a collector of the input transistor produces open-loop voltage gain, and amplified signals on the collector of the input transistor are applied to a base of the output transistor. In one such case, the input transistor is connected in a common emitter configuration. In another such case, emitter voltage of the input transistor is raised by a diode. The differential transimpedance amplifier may be configured with degenerated current sources for facilitating rejection of common mode input signals. The device may be included, for example, in a system-on-chip, or may be implemented with discrete components.

Another embodiment provides a device for mixing signals that includes a Gilbert mixer stage having a cascode connected switching quad, and a differential transimpedance amplifier input stage operatively coupled to the Gilbert mixer stage for generating a current signal that is applied to the cascode connected switching quad of the Gilbert mixer stage. In this example configuration, the differential transimpedance amplifier comprises an input transistor and an output transistor, and an input signal is applied to a base of the input transistor and amplified signals on the collector of the input transistor are applied to a base of the output transistor. In addition, the current signal is taken from a collector of the output transistor, and the differential transimpedance amplifier has closed loop negative feedback taken from an emitter of the output transistor. In one such case, the input transistor is connected in a common emitter configuration. In another such case, emitter voltage of the input transistor is raised by a diode. The differential transimpedance amplifier may be configured with degenerated current sources for facilitating rejection of common mode input signals. The device may be included, for example, in a system-on-chip, or may be implemented with discrete components.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

A Gilbert cell mixer design is disclosed. Instead of using a differential transconductance stage as typically done, the design employs a differential transimpedance amplifier input stage. By utilizing a transimpedance input stage to the Gilbert mixer, feedback is used to obtain higher linearity without sacrificing noise performance. The transimpedance input stage supplies a current signal to the cascode connected Gilbert switching quad, so the transimpedance amplifier output is taken from the collector of the transimpedance amplifier output transistor, instead of the emitter as typically done with transimpedance amplifiers.

General Overview

Figure 1:
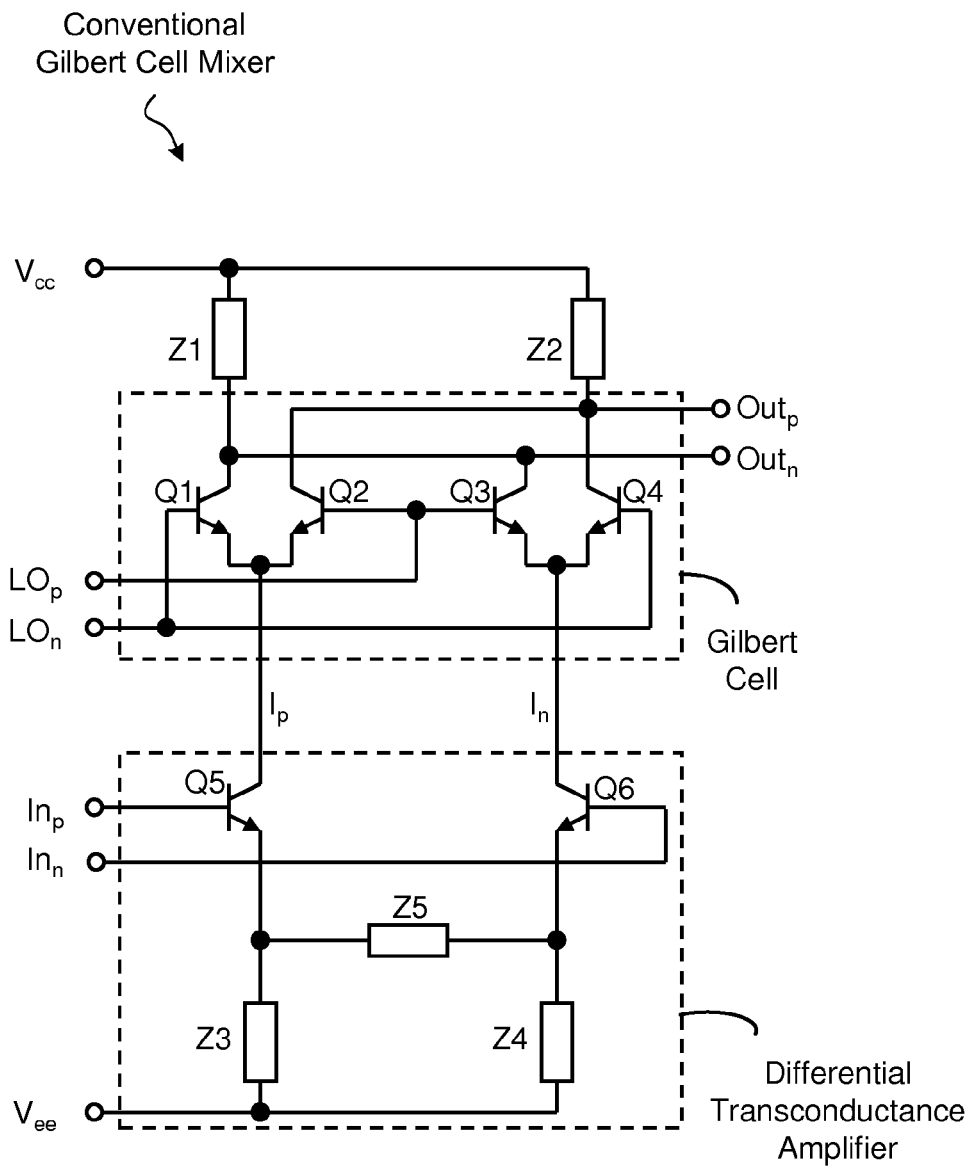
FIG. 1 illustrates a conventional Gilbert cell mixer design.

As previously explained, a typical Gilbert cell mixer utilizes a transconductance input stage, as illustrated by the circuit of FIG. 1. As can be seen, the circuit includes a differential transconductance amplifier stage (RF input stage) operatively coupled to a Gilbert cell (mixing stage). The power supplies of Vcc and Vee are provided as typically done.

In such a typical Gilbert cell mixer, the RF input stage to the mixer has a differential transconductance pair of transistors, Q5 and Q6. This transistor pair converts an applied input voltage at the bases to an output current at the collectors. The differential input voltage is designated as $In_p$ and $In_n$, and the differential output current is designated as $I_p$ and $I_n$. The differential output current $I_p$ and $I_n$ is then mixed with the local oscillator signal ($LO_p$ and $LO_n$) applied to the Gilbert switching quad, which is made up of Q1-Q4. The differential output signal of the mixer stage ($Out_p$ and $Out_n$) is taken at the collectors of the Gilbert quad.

While this conventional approach is efficient in terms of relatively few components used, it has shortcomings. For instance, Q5 and Q6 utilize no feedback. Linearity is dependent on the semiconductor process used and how much emitter degeneration is used, which is impedance element Z5. When impedance Z5 is a resistive element for broadband applications, high linearity can be achieved at the expense of low mixer circuit gain and high noise figure. Narrow band applications can partially mitigate this shortcoming by utilizing reactive components (i.e., inductors or capacitors) for Z5. However, there are still limits in how linear the differential transconductance amplifier can be made. The other impedances Z1-Z4 are generally used for shaping the circuitry frequency response and gain. Typical impedance values are as follows: Z1=Z2=100 ohms; Z3=Z4=70 ohms; and Z5=45 ohms.

In accordance with an embodiment of the present invention, the differential transconductance amplifier input stage is replaced with a transimpedance amplifier circuit utilizing negative feedback. This technique provides several improvements in performance over the open-loop input stage, including higher linearity without sacrificing noise performance.

Mixer Circuit

Figure 2:
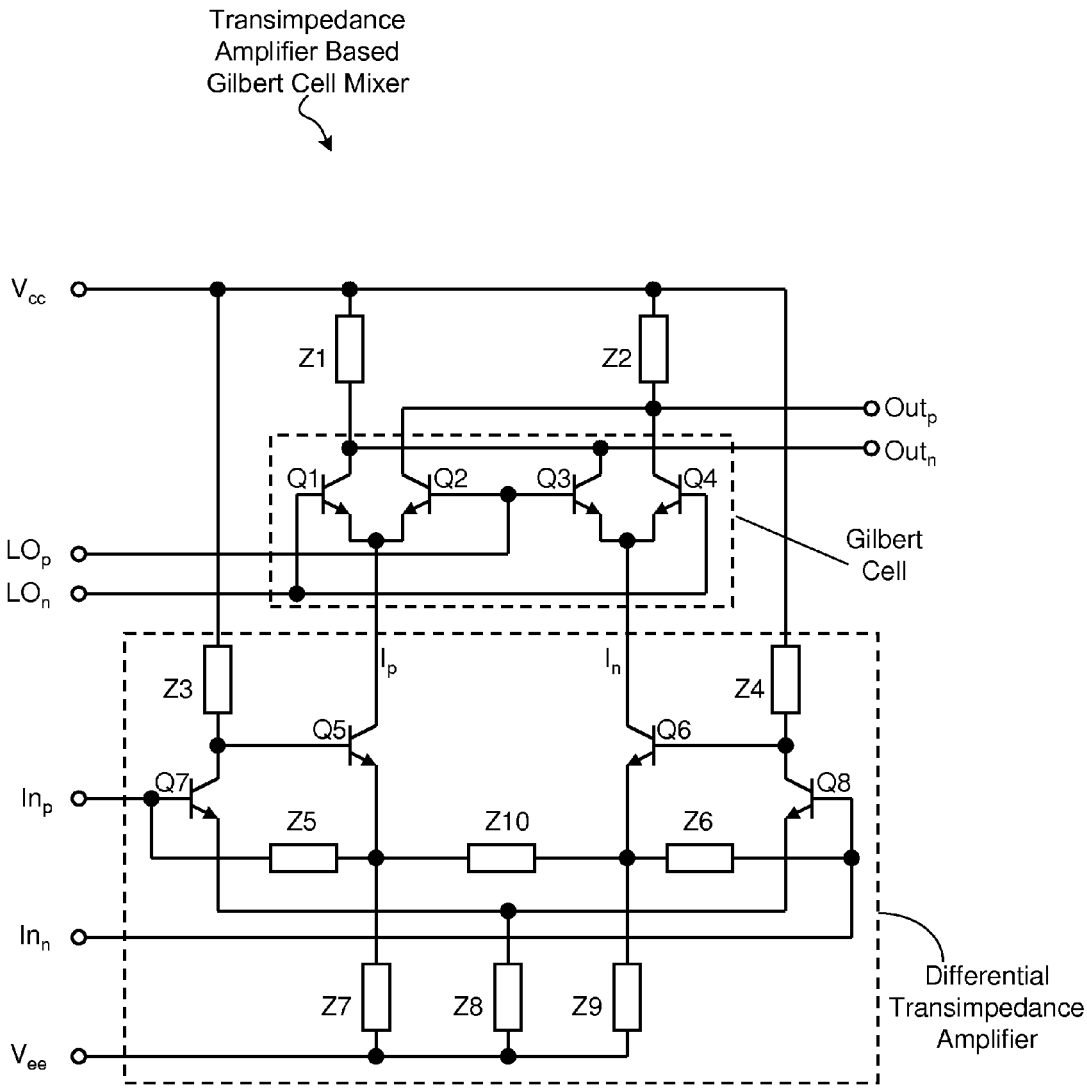
FIG. 2 illustrates a transimpedance amplifier based Gilbert cell mixer, in accordance with an embodiment of the present invention.

FIG. 2 illustrates a Gilbert cell mixer configured with a differential transimpedance amplifier input stage, in accordance with one embodiment of the present invention.

As can be seen, the circuit is implemented with transistors Q1-Q8 and impedances Z1-Z10. The present invention is not intended to be limited to a particular type of transistors or impedances. Rather, the mixer circuit topology shown in FIG. 2 can be implemented using any number of suitable transistor and impedance types. For example, the transistors Q1-Q8 can be implemented with CMOS FETs or Bipolar Junction Transistors, or any other suitable transistor technology. Likewise, the impedances can be, for instance, resistive, capacitive, inductive, or a combination thereof. The Gilbert cell (mixer stage) can be implemented as typically done.

As can further be seen, the transimpedance amplifier is a differential circuit and has symmetrical qualities, thereby allowing analysis of one circuit half to be equally applied to the other circuit half. For instance, this example embodiment can be discussed in terms of the left circuit half, which generally includes transistors Q5 and Q7 and impedances Z3, Z5, Z7, Z8, and Z10. The discussion of this left circuit half will equally apply the right circuit half, which generally includes transistors Q6 and Q8 and impedances Z4, Z6, Z9, Z8, and Z10.

In operation, transistors Q7 and Q5 form a transimpedance input amplifier. The RF input signal ($In_p$) is applied to the base of transistor Q7. A large collector impedance Z3 produces large open-loop voltage gain at transistor Q7. In some embodiments, transistor Q7 is connected in a common emitter configuration (where impedance Z8 is a short to ground). The amplified signal on the collector of transistor Q7 is then applied to the base of transistor Q5, which serves two functions. In particular, transistor Q5 buffers the signal from the collector of transistor Q7 to drive the feedback resistance. In addition, transistor Q5 generates a current output ($I_p$) at the collector which is applied to the Gilbert switching quad, at the emitters of the Q1-Q2 transistor pair. In typical differential transimpedance amplifier circuits, the output would be taken from the emitter of transistor Q5 as a voltage signal, with transistor Q5 configured in a common collector configuration. This embodiment, however, has adapted the differential transimpedance amplifier circuit into a new configuration, where the feedback is still tapped off the emitter of transistor Q5, but the output is taken as a current signal ($I_p$) from the collector of transistor Q5. The Gilbert switching quad (more specifically, transistors Q1 and Q2 of the quad) uses the current signal $I_P$ in normal fashion.

Given the symmetry associated with a differential circuit, and as previously explained, everything stated for transistors Q7 and Q5 can be applied to transistors Q8 and Q6, respectively. For purposes of clarity, however, a detailed discussion is now provided. In operation, transistors Q8 and Q6 form a transimpedance input amplifier. The RF input signal ($In_n$) is applied to the base of transistor Q8. A large collector impedance Z4 produces large open-loop voltage gain at transistor Q8. In some embodiments, transistor Q8 is connected in a common emitter configuration (where impedance Z8 is a short to ground). The amplified signal on the collector of transistor Q8 is then applied to the base of transistor Q6, which serves two functions. In particular, transistor Q6 buffers the signal from the collector of transistor Q8 to drive the feedback resistance. In addition, transistor Q6 generates a current output ($I_n$) at the collector which is applied to the Gilbert switching quad, at the emitters of the Q3-Q4 transistor pair. As previously explained, the output of a typical differential transimpedance amplifier circuit would be taken from the emitter of transistor Q6 as a voltage signal, with transistor Q6 configured in a common collector configuration. This embodiment, however, has adapted the differential transimpedance amplifier circuit, where the feedback is still tapped off the emitter of transistor Q6, but the output is taken as a current signal ($I_n$) from the collector of transistor Q6. The Gilbert quad (more specifically, transistors Q3 and Q4 of the quad) uses the current signal $I_n$ in normal fashion.

The differential transimpedance amplifier based approach has advantages over a conventional transconductance approach in the following ways. The closed loop feedback can greatly improve the linearity of the mixer circuit, without sacrificing gain or noise figure. This can be done with resistive elements to maintain a broad band response. In the traditional transconductance approach, improved linearity is achieved by increasing the degeneration impedance, Z5 in FIG. 1. However, and as previously explained, this reduces the gain and increases the noise figure significantly, especially if resistive degeneration is used in a broad band application. In contrast, a mixer configured with a differential transimpedance amplifier input stage as described herein decouples linearity and gain. As such, high gain and low noise figure can be achieved simultaneously with high linearity. Most of the linearizing benefits achieved with negative feedback taken from the emitter of transistor Q5 are present in the current-mode signal taken from the collector of Q5. Likewise, most of the linearizing benefits achieved with negative feedback taken from the emitter of transistor Q6 are present in the current-mode signal taken from the collector of Q6. In this sense, taking the output from the transimpedance amplifier circuit from the collectors of Q5 and/or Q6 is beneficial.

Impedance elements Z8 and Z10 generally enable the mixer circuit to behave in a differential way. The $In_n$ input can be left open or terminated while the $In_p$ input is driven with a signal, or vise-versa. Differential behavior partially reconstructs an inverted copy of the applied RF input signal in the non-drive half of the input stage. Impedance Z8 can be, for example, any passive device or combination of such devices, one or more diode drops, an active current source, or shorted directly to ground. Impedances Z7, Z9, and Z10 effectively shape the frequency response and gain of mixer circuit, and can be implemented, for instance, with one or more passive devices (e.g., resistors, capacitors, inductors, or combination thereof). Alternatively, or in addition to, impedances Z7, Z9, and Z10 can be implemented as one or more diode drops or an active current source, as discussed with reference to FIGS. 3*a*-*b*.

In some embodiments, the RF input ($In_p$ and $In_n$) can be applied to the transimpedance input stage through an impedance network. This impedance can be tailored to meet the overall circuit gain and input matching requirements. For instance, the mixer circuit gain for the RF input $In_p$ is generally proportional to Z1/Z5||Z7||(Z10/2), where || represents parallel combination of networks. Similarly, given differential circuit symmetries, the mixer circuit gain for the RF input $In_n$ is generally proportional to Z2/Z6||Z9||(Z10/2).

The transistors shown in this example of FIG. 2 are bipolar NPN transistors, but other transistor types (e.g., BJT PNP, FETs) can be used, as will be apparent in light of this disclosure. Moreover, mixer circuitry configured in accordance with an embodiment of the present invention can be implemented, for example, with discrete componentry (e.g. printed circuited board or card populated with discrete components) or as one or more integrated circuits (e.g., system-on-chip, or chip set formed using any number of suitable semiconductor processes). In one example case, Silicon Germanium (SiGe) processes are used, such as IBM processes 5 HP, 7 HP or 8 HP. Indium Phosphide, regular Silicon, Indium Gallium Phosphide, Gallium Arsenide are all viable processes generally available that can be used to implement an embodiment of the present invention.

Example impedance values in accordance with one specific embodiment are as follows: Z1=Z2=100 ohms; Z3=Z4=450 ohms; Z5=Z6=60 ohms; Z7=Z9=70 ohms; Z8=0 ohms (short circuit); and Z10=45 ohms. The transistors Q1-Q8 in one such example case are bipolar NPN transistors implemented using standard Silicon Germanium (SiGe) semiconductor processes. The impedances Z1-Z10 can be implemented, for instance, as thin film resistors. A number of variations on the mixer circuit can be implemented.

Dynamic Range Increase

Figure 3A:
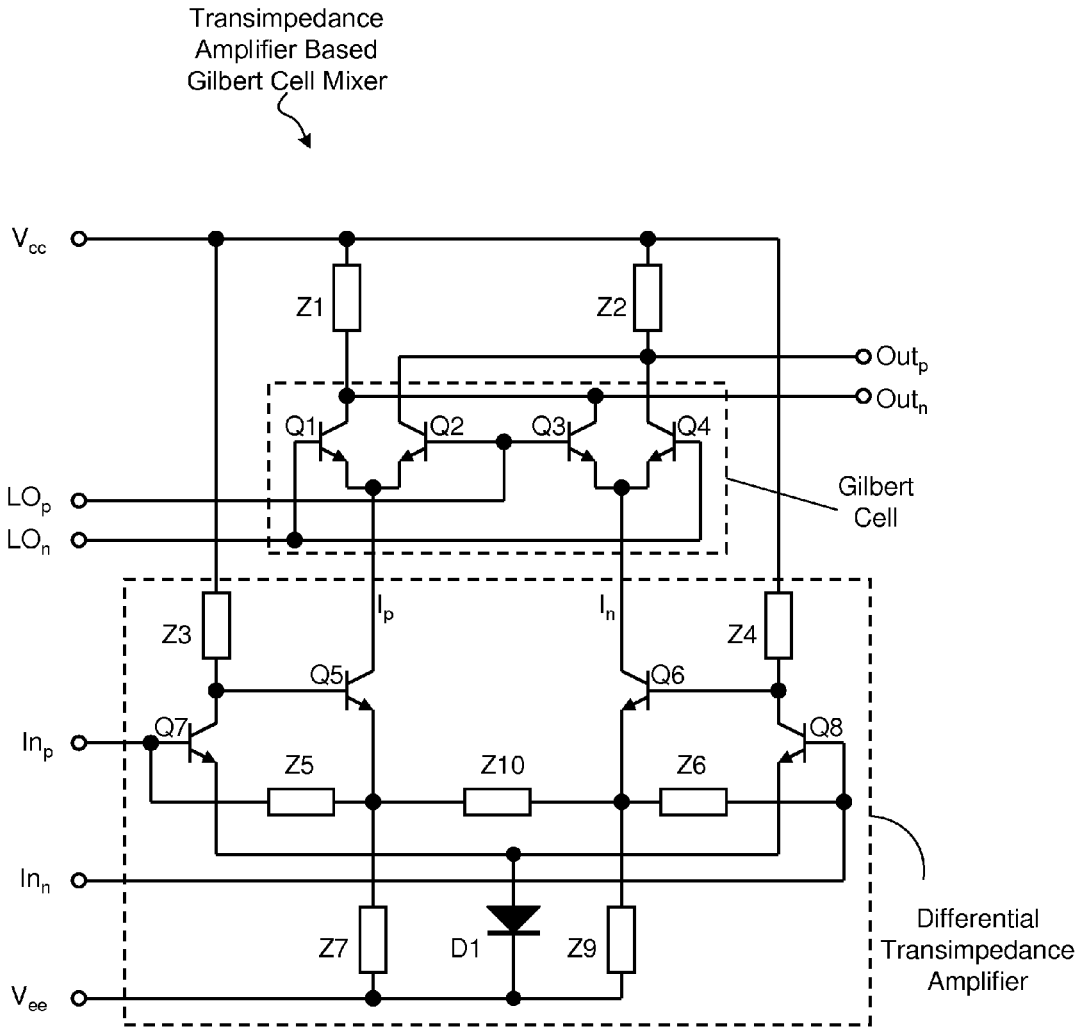
FIG. 3*a* illustrates a transimpedance amplifier based Gilbert cell mixer, in accordance with another embodiment of the present invention.

One such variation is shown in FIG. 3*a*. In this example embodiment, the circuit is mostly configured as shown in FIG. 2, and can have the following example impedance values in: Z1=Z2=100 ohms; Z3=Z4=450 ohms; Z5=Z6=68 ohms; Z7=Z9=70 ohms; and Z10=180 ohms. Instead of a short circuit, however, impedance Z8 is implemented with a diode (e.g., SiGe) as shown in FIG. 3*a*. Just as previously explained with reference to FIG. 2, the various components can be implemented using standard SiGe semiconductor processes, although other embodiments can be implemented using discrete components if so desired.

In any case, in this specific embodiment shown in FIG. 3*a*, the emitter voltage of transistors Q7 and Q8 is effectively raised by diode D1 (e.g., by 0.4 to 0.9 VDC, depending on the diode junction type). As such, all of the bias voltages are shifted upward in the transimpedance input stage. This allows more room for voltage swing at the emitters of transistors Q5 and Q6, effectively increasing the dynamic range of the mixer circuit. Note, however, that this increased dynamic range comes at the expense of increased power consumption.

Common Mode Rejection

Figure 3B:
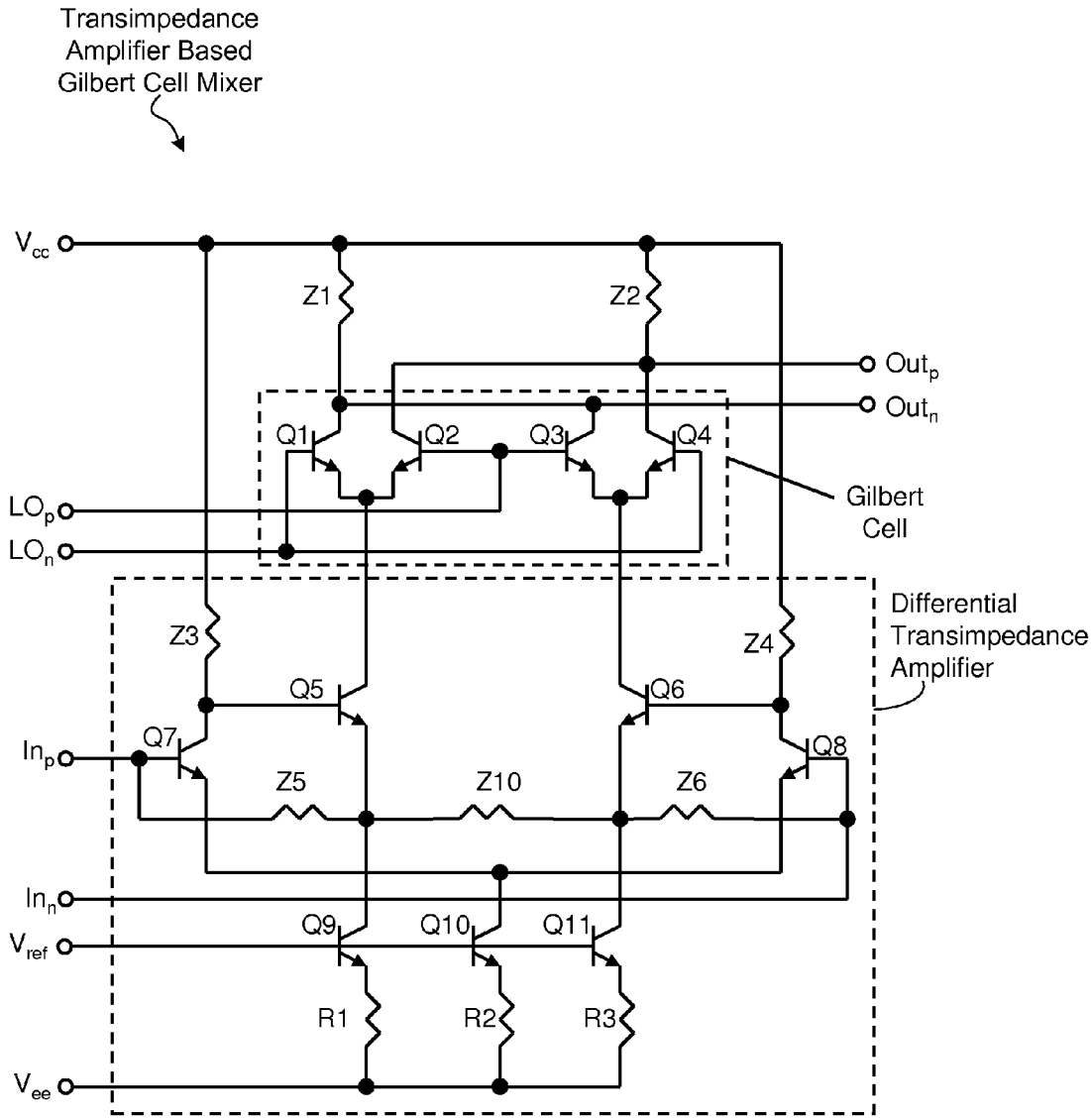
FIG. 3*b* illustrates a transimpedance amplifier based Gilbert cell mixer, in accordance with another embodiment of the present invention.

Another variation is shown in FIG. 3*b*. In this example embodiment, the circuit is mostly configured as shown in FIG. 2, and can have the following example impedance values in: Z1=Z2=100 ohms; Z3=Z4=450 ohms; Z5=Z6=68 ohms; and Z10=180 ohms. As shown in FIG. 3*b*, however, impedances Z7-Z9 are replaced with degenerated current sources Q9-Q11 (including the corresponding resistors R1-R3), which are biased from a voltage reference Vref. Just as previously explained with reference to FIGS. 2 and 3*a*, the various components can be implemented using, for example, standard semiconductor processes, although other embodiments can be implemented using discrete components if so desired.

Vref can be generated, for example, on chip or by another circuit. In any case, this configuration enables the transimpedance input stage to better reject common mode input signals applied to $In_p$ and $In_n$. Again, additional power supply headroom is needed, and thus more power is required. So consideration of the various trades should be made. Transistors Q9-Q11 can be, for example, MOSFET devices without negatively impacting circuit performance. In one such example case, MOSFET devices are provided using the IBM® 8 HP SiGe BiCMOS process, although any number of suitable semiconductor processes can be used.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A device for mixing signals, comprising:

a Gilbert mixer stage having a cascode connected switching quad; and a differential transimpedance amplifier input stage operatively coupled to the Gilbert mixer stage, and for generating a current signal that is applied to the cascode connected switching quad of the Gilbert mixer stage, the differential transimpedance amplifier configured with a pair of input transistors for receiving an input signal and a pair of output transistors for outputting the current signal, wherein the output transistors are directly coupled to each other by a first impedance so as to allow signal coupling between a first node associated with one of the output transistors and a second node associated with the other output transistor, wherein each of the first and second nodes are further operatively coupled to a power supply node by circuitry comprising at least second and third impedances, respectively, and wherein the first impedance in combination with at least the second and third impedances shape frequency response and gain of the device.

2. The device of claim 1 wherein the current signal is provided at collectors of the output transistors, and the first impedance directly couples emitters of the output transistors.

3. The device of claim 1 wherein the differential transimpedance amplifier has closed loop negative feedback taken from an emitter of an output transistor.

4. The device of claim 1 wherein the input signal is applied to bases of the input transistors, and amplified signals on collectors of the input transistors are applied to corresponding bases of the output transistors.

5. The device of claim 4 wherein the current signal is provided at collectors of the output transistors, and the first impedance directly couples emitters of the output transistors and the second and third impedances directly couple the emitters of the output transistors to the power supply node.

6. The device of claim 4 wherein the input transistors are connected in a common emitter configuration.

7. The device of claim 4 wherein emitter voltage of the input transistors is raised by a diode.

8. The device of claim 1 wherein the circuitry operatively coupling the first and second nodes to the power supply node is further configured with one or more degenerated current sources for facilitating rejection of common mode input signals.

9. The device of claim 8 wherein the device is included in a system-on-chip and the one or more degenerated current sources are biased from a voltage reference generated on-chip.

10. A device for mixing signals, comprising:

a Gilbert mixer stage having a cascode connected switching quad; and a differential transimpedance amplifier input stage operatively coupled to the Gilbert mixer stage, and for generating a current signal that is applied to the cascode connected switching quad of the Gilbert mixer stage, wherein the differential transimpedance amplifier is configured with a pair of input transistors for receiving an input signal and a pair of output transistors for outputting the current signal, wherein emitters of the output transistors are directly coupled to each other by a first impedance so as to allow signal coupling therebetween and are further operatively coupled to a power supply node by circuitry comprising at least second and third impedances, respectively, and the current signal is provided at collectors of the output transistors, and the differential transimpedance amplifier has closed loop negative feedback taken from the emitters of the output transistors, and wherein the first impedance in combination with at least the second and third impedances shape frequency response and gain of the device.

11. The device of claim 10 wherein the input signal is applied to bases of the input transistors, and amplified signals on collectors of the input transistors are applied to bases of the output transistors.

12. The device of claim 11 wherein the input transistors are connected in a common emitter configuration.

13. The device of claim 11 wherein emitter voltage of the input transistors is raised by a diode.

14. The device of claim 10 wherein the circuitry operatively coupling the emitters of the output transistors to the power supply node is further configured with one or more degenerated active current sources for facilitating rejection of common mode input signals, the one or more degenerated active current sources biased from a voltage reference.

15. The device of claim 10 wherein the device is included in a system-on-chip.

16. A device for mixing signals, comprising:

a Gilbert mixer stage having a cascode connected switching quad; and a differential transimpedance amplifier input stage operatively coupled to the Gilbert mixer stage, and for generating a current signal that is applied to the cascode connected switching quad of the Gilbert mixer stage, wherein the differential transimpedance amplifier comprises a pair of input transistors for receiving an input signal and a pair of output transistors for outputting the current signal, wherein emitters of the output transistors are directly coupled to each other by a first impedance so as to allow signal coupling therebetween and are further operatively coupled to a power supply node by circuitry comprising at least second and third impedances, respectively, and the input signal is applied to bases of the input transistors and amplified signals on collectors of the input transistors are applied to base of the output transistors, and the current signal is provided at collectors of the output transistors, and the differential transimpedance amplifier has closed loop negative feedback taken from emitters of the output transistors, and wherein the first impedance in combination with at least the second and third impedances shape frequency response and gain of the device.

17. The device of claim 16 wherein the input transistors are connected in a common emitter configuration.

18. The device of claim 16 wherein emitter voltage of the input transistors is raised by a diode.

19. The device of claim 16 wherein the circuitry operatively coupling the emitters of the output transistors to the power supply node is further configured with one or more degenerated active current sources for facilitating rejection of common mode input signals, the one or more degenerated active current sources biased from a voltage reference.

20. The device of claim 16 wherein the device is included in a system-on-chip.

* * * * *